US005727368A

United States Patent [19]

Wernimont et al.

[11] Patent Number: 5,727,368

[45] Date of Patent: Mar. 17, 1998

[54] HYBRID MOTOR SYSTEM WITH A CONSUMABLE CATALYTIC BED A COMPOSITION OF THE CATALYTIC BED AND A METHOD OF USING

[76] Inventors: Eric J. Wernimont, 18250 Marsh La. Apt. 302, Dallas, Tex. 75287; Scott E. Meyer, 5170 Bradyville Pike, Murfreesburo, Tenn. 37130; Mark C. Ventura, P.O. Box 40107, Downey, Calif. 90239

[21] Appl. No.: 623,937

[22] Filed: Mar. 28, 1996

[51] Int. Cl.[6] ..... C06D 5/04

[52] U.S. Cl. ..... 60/218; 60/219; 60/207; 60/256; 149/22

[58] Field of Search ..... 60/39.06, 39.141, 60/39.462, 39.822, 218, 214, 219, 207, 256; 149/19.9, 22

[56] References Cited

U.S. PATENT DOCUMENTS

| | | | |
|---|---|---|---|
| 2,791,883 | 5/1957 | Moore et al. . | |
| 3,287,911 | 11/1966 | Klein . | |
| 3,354,647 | 11/1967 | Aycock | 60/220 |
| 3,429,754 | 2/1969 | Alelio . | |
| 3,664,132 | 5/1972 | Vessel et al. . | |
| 3,667,231 | 6/1972 | Hubbuch et al. . | |
| 3,698,191 | 10/1972 | Ebeling, Jr. . | |
| 4,206,006 | 6/1980 | Ratz . | |
| 4,698,965 | 10/1987 | Delchev et al. | 60/218 |
| 4,787,091 | 11/1988 | Wagner | 372/89 |

OTHER PUBLICATIONS

Ronald V. Osmond, 'An Experimental Investigation of a Lithium Aluminum Hydride —Hydrogen Peroxide Hybrid Rocket', *Aerospace Chemical Engineering*, No. 61, vol. 62, 1966.

M. Pugibet, H. Moutet, 'On the Use of Hydrogen Peroxide as Oxidizer in Hybrid Systems', NASA Technical Translation TTF–13034, Washington, D.C., May 1970.

M. Pugibet, H. Moutet, 'Utilisation dans les systemes hybrides de l'eau oxygenee comme comburant', *La Recherche Aerospatiale*, No. 132, Sep.–Oct. 1969, pp. 15–31.

E. Wernimont, S. Meyer, 'Hydrogen Peroxide Hybrid Rocket Engine Performance Investigation', AIAA 94–3147, 30th Joint AIAA/SAE/ASME/ASEE Propulsion Conference, Indianapolis, IN, Jun. 27–29, 1994.

E. Wernimont, S. Heister, 'Performance Characterization of Hybrid Rockets Using Hydrogen Peroxide Oxidizer', AIAA 95–3084, 31st AIAA/SAE/ASME/ASEE Propulsion Conference, San Diego, CA, Jul. 10–12, 1995.

J.J. Rusek, 'Cation Variance Effects in Hydrogen Peroxide Decomposition', AIAA 95–3087, 31st AIAA/SAE/ASME/ASEE Propulsion Conference, San Diego, CA, Jul. 10–12, 1995.

*Primary Examiner*—Charles G. Freay

[57] ABSTRACT

A method, device and composition for achieving ignition and sustained combustion using a solid consumable catalytic bed (CCB) is described. The CCB accomplishes this by decomposition of an injected fluid. Initially this reaction is catalytic or hypergolic in nature, eventually becoming entirely thermal as the CCB is consumed in the reaction generated. The CCB may be placed in a hybrid motor system such that the decomposed injected fluid will undergo combustion with the solid grain. When the injected fluid is high concentration hydrogen peroxide the catalytic materials of construction for the CCB are selected from the metallic hydride family, the manganese oxide family and the cuprocyanide family.

26 Claims, 3 Drawing Sheets

HYBRID MOTOR SYSTEM WITH A CONSUMABLE CATALYTIC BED A COMPOSITION OF THE CATALYTIC BED AND A METHOD OF USING

BACKGROUND OF THE INVENTION

The invention described herein relates to a hypergolic reaction between an injected fluid and a novel consumable catalytic bed and a method of using same. This reaction is used to decompose the injected fluid allowing it to undergo combustion with a solid grain. In addition, this reaction may be used to achieve high temperature gases which may be used to produce light, heat or do mechanical work such as propulsion or torching.

Chemical motors are employed to perform work such as propulsion or explosion. In the field of chemical motors, such motors employ one of two means to produce thrust, the solid propellant motor or the fluid propellant motor where the fluid propellant is in a liquid, gaseous or gelled state. Each method is named to identify the physical state of the propellants, both oxidizer and fuel, prior to the combustion process. A hybrid motor combines these two means. In a hybrid motor system, either the fuel is a solid with the oxidizer being a fluid or the oxidizer is a solid with the fuel being a fluid.

The invention described herein relates to a hybrid motor system that uses either a fluid oxidizer and a solid fuel or a solid oxidizer and fluid fuel. In one embodiment, the fluid is an oxidizer consisting of high concentration hydrogen peroxide. Hydrogen peroxide has the unique property that it will undergo decomposition into oxygen, water and energy in the presence of certain chemical catalysts. If the concentration of hydrogen peroxide is high enough, this decomposition will produce hot gas sufficient to spontaneously initiate combustion of a fuel. Commercially available hydrogen peroxide typically includes materials such as stannates and phosphates in order to reduce the reactivity of the hydrogen peroxide in the presence of contaminates. These materials are often referred to as 'stabilizers'. Commercial grade or stabilized hydrogen peroxide contains approximately 5 to 100 ppm of stabilizers. United States military specification grade hydrogen peroxide contains less than 5 ppm of any stabilizers and is commonly referred to as 'unstabilized'. The concept of this invention is not limited to the use of either stabilized or unstabilized hydrogen peroxide. Other oxidizer and fuel combinations also may be employed if the fluid reacts in a manner similar to the decomposition of hydrogen peroxide.

Decomposition of hydrogen peroxide for use in a hybrid motor has been achieved in other prior devices. The most commonly used device is the silver screen catalytic bed. Such a method is patented by Moore et al., disclosed in U.S. Pat. No. 2,791,883. Another prior device uses liquid injection of an aqueous chemical catalytic solution impinging onto a liquid injected stream of hydrogen peroxide. Further, a publication by Pugibet et al. (NASA Technical Translation TTF-13034, 1970.) describes a method using a chemical catalyst as a coating on the surface of a hybrid fuel grain. Finally, the patents of Klein and Vessel et al. (U.S. Pat. Nos. 3,287,911 and 3,664,132) employ a fuel grain composed entirely of a chemical that is hypergolic with the liquid oxidizer used in each invention.

The silver screen catalytic bed typically is a tightly packed mesh of approximately 25 to 200 layers of silver plated screens. Each silver screen is glazed with a samarium nitrate ($SaNO_3$) solution. In such a device, liquid hydrogen peroxide is introduced under pressure, and forced to flow through the packed screen bed. The fluid follows a torturous path through the screens, contacting a large surface area of chemically catalytic material, exiting the bed fully decomposed. The silver screen catalytic bed requires the use of unstabilized hydrogen peroxide. If stabilized hydrogen peroxide is used, such a catalytic bed will be unable to decompose the hydrogen peroxide or the bed will be poisoned and the decomposition will stop before combustion is initiated. The silver screen catalytic device also is expensive due to the use of precious metals and the labor-intensive manufacturing of the complex screen mesh. In addition, the 'mass flux' level (i.e., the mass flow rate divided by the cross-sectional flow area) that may be decomposed with this device requires that the catalytic bed diameter be roughly the same as the diameter of the port of the solid fuel. This requirement dictates a relatively large, consequently heavy, device that must be carried with the motor system as inert weight. This has the effect of reducing the payload mass that can be lifted by a given motor system.

Liquid injection of catalytic fluids requires the use of a two fluid system. Consequently, this method nullifies a major advantage of using a hybrid system. That being elimination of one of the fluid systems that is used in a bi-propellant fluid system. Although this method may employ stabilized hydrogen peroxide it requires a complicated fluid injection system.

The use of a surface coating on the fuel (Pugibet et al.) to initiate combustion requires atomization of the injected unstabilized hydrogen peroxide and that the motor initially operate at low port mass flux levels. The mass flux levels through the solid grain port reported by Pugibet et al. are approximately four times below that necessary for a practical hydrogen peroxide hybrid motor system.

The hybrid fuel compositions patented by Klein use high concentration hydrogen peroxide as the injected liquid where the fuel is composed of alkali metal carbides, potassium cuprocyanide, alkali metal azide and a binder. The hybrid fuel composition patented by Vessel et al. uses concentrated nitric acid as the injected liquid where the fuel is tetraformaltrisazine and a binder. Because both of these concepts use hypergolic materials in the entire fuel grain, large quantities of materials that are both expensive and toxic to handle are required. In addition, the combustion products of these fuel/oxidizer combinations are undesirable from an environmental standpoint.

The novel device, method and composition described herein utilizes a consumable catalytic bed (CCB). This device, method and composition have several novel qualities that address each of the previously mentioned limitations. In particular, the device which is used in the method:

1. is the only known solid catalytic bed that may be used with highly stabilized hydrogen peroxide which reduces the hazards of handling the oxidizer by technicians and persons during operation of the propulsion system;

2. is the only known catalytic bed that is consumed during the combustion process, decreasing inert mass, thereby adding to the performance of the overall propulsion system;

3. may be used with a simplified atomization and spray injection pattern with large droplet sizes making it very simple to construct in contrast to other systems;

4. utilizes the preferred single fluid system concept of a hybrid motor;

5. requires minimal time to construct and uses a minimum of expensive and toxic materials;

6. may be used in applications with port mass flux levels up to double that required for optimal operation of a hydrogen peroxide hybrid motor;

7. is compact, any effect from exotic materials can be made to be less than 1% of the total mass expelled;

8. is not location limited to use near the fluid injection point;

9. is not required for the duration of the motor operation; and 10. is not solid grain selection limited.

BRIEF SUMMARY OF THE INVENTION

In a hybrid motor the CCB acts as an ignition device for the injected fluid and the solid grain. Initially the CCB acts as a decomposition surface for the injected fluid. During decomposition of the injected fluid at the surface of the CCB energy sufficient to decompose the solid grain and energy sufficient to overcome the activation threshold of all the decomposed products can be generated. This requirement is enough to spontaneously achieve combustion between the products from the CCB, the injected fluid decomposition products and the decomposition products of the solid grain. As more fluid is injected the CCB is consumed exposing more catalyst for an identical type reaction described above. Once the CCB is completely consumed the decomposition of the injected fluid is achieved by only thermal means, the energy source being the combustion reaction created. The motor may then be operated until the flow of the injected fluid is terminated.

BRIEF DESCRIPTION OF THE DRAWINGS

In FIGS. 1 and 2, the axial center of the CCB is void of material forming a fin surface geometry configuration with the CCB materials of construction.

In FIG. 5 a close-up view of the CCB (item 8) is shown set in the solid grain (item 5). Item 9 roughly approximates the location of the division between partially and fully thermally decomposed injected fluid. Item 10 depicts a possible location of catalytic decomposition for injected fluid at the surface of the CCB.

DETAILED DESCRIPTION OF THE INVENTION

Figure 5:
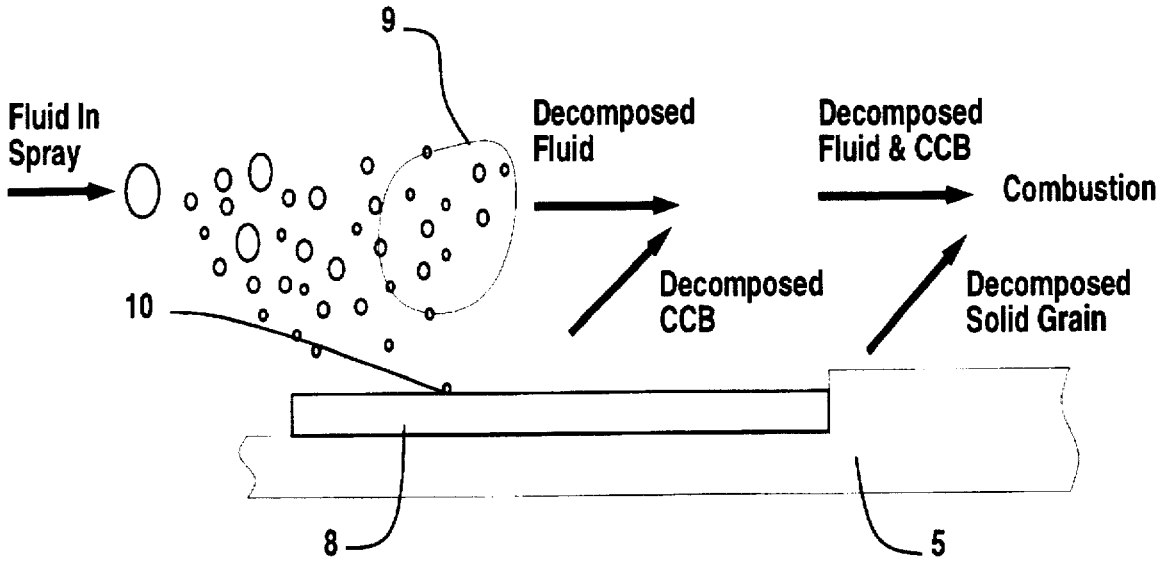
FIG. 5 is a view of the surface process associated with fluid impingement on a CCB during the ignition process.

The CCB serves to react with the injected fluid in such a way as to achieve a hypergolic reaction. This reaction may be used for many purposes among them are: initiation of an explosive mixture, hot gas generation or to ignite a hybrid motor. Although the CCB's utility is not limited to ignition of a hybrid motor this will be used as an illustrative end. In a hybrid system accomplishment of ignition is the primary use of the CCB with sustained combustion being the secondary result. For a hybrid system the CCB acts as a catalytic site for the fluid that is introduced onto its surface. This reaction is illustrated in FIG. 5. The fluid may be chemically classified as either an oxidizer or a fuel. The fluid may also exist in either a liquid, gaseous or gelled state. It is only important that the fluid be capable of being transferred by application of pressure. The catalytic reaction that occurs at the surface of the CCB between the fluid and the CCB should be of such manner to decompose said fluid. This surface reaction may also involve decomposition of materials in the CCB through either thermal or catalytic (the fluid may also be catalytic to the CCB materials) means. For a hybrid system this reaction at the CCB surface need only produce energy by means of either combustion or through only decomposition such that the local heat transfer is sufficient to thermally decompose the solid grain. If the design is properly accomplished the decomposition products of the solid grain and the decomposition products of the injected fluid are now in gaseous form, intimately mixed and in the presence of energy. Spontaneous combustion of the decomposition products ensues. Since the CCB is composed of materials that either thermally decompose or are catalytically decomposed it is consumed during the injection of the fluid. This in effect exposes another CCB surface that will decompose the next wave of injected fluid. This process continues until the CCB is entirely consumed or until the fluid is no longer injected. The solid grain may be made substantially of either an oxidizer or a fuel, usually the converse of the introduced fluid. An example of such a fluid/solid grain combination would be liquid 85% hydrogen peroxide with the solid grain composed of high density polyethylene.

In the case where the CCB is completely consumed the continued combustion of the injected fluid with the solid grain is accomplished by only thermal decomposition of the injected fluid. In this case the combustion products mused contain and be able to transfer sufficient energy to decompose the injected fluid, decompose the solid grain and overcome the activation energy of those products. For this to be accomplished it is advantageous for the injected fluid to have monopropellant characteristics. Such fluids release energy when decomposed, examples of such fluids are: hydrogen peroxide ($H_2O_2$), hydrazine ($N_2H_4$), nitromethane ($CH_3NO_2$) and ethylene oxide ($C_2H_3OH$). Examples of chemical catalyst for hydrogen peroxide are: $NaBH_4$, HLi, $NH_2Li$, $BH_4Li$, $AlH_4Li$, $KBH_4$, $MnO_2$, $KMnO_4$, $Ca(MnO_4)_2$ and $NaMnO_4$.

Figure 1:
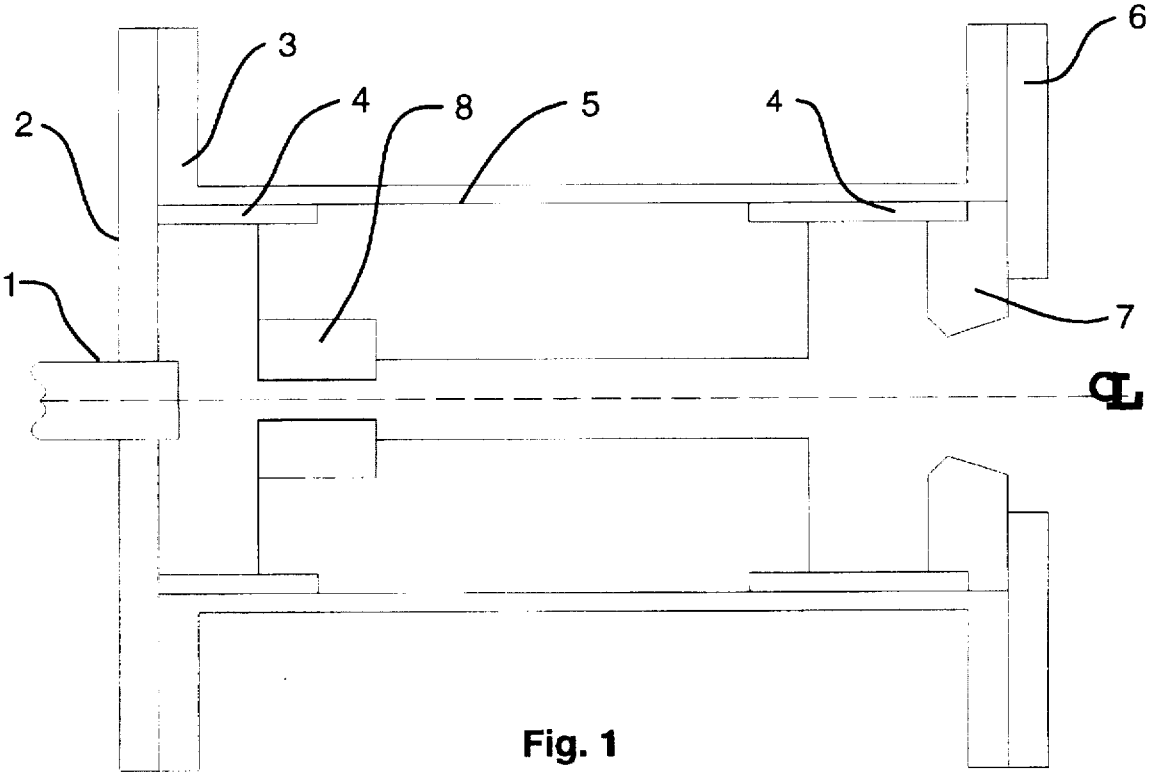
FIG. 1 is an axisymetric view of a single port hybrid motor combustion chamber that uses a CCB for ignition. The location of the CCB, item 8, in the hybrid motor is shown. Item 1 depicts the location of the forward injector through which the fluid is atomized and enters the combustion chamber. Items 2, 3 and 6 [not part of the invention] are the forward flange, the case and the aft flange respectively. These items serve as a pressure vessel for the combustion chamber. Item 4 [not part of the invention] is the internal thermal insulation which serves to protect the pressure vessel from the combustion gas temperatures. Item 7 [not part of the invention] is a nozzle through which the combustion gases exit, producing thrust. Item 5 is the solid grain for the hybrid rocket motor shown in a single circular port configuration.
Figure 2:
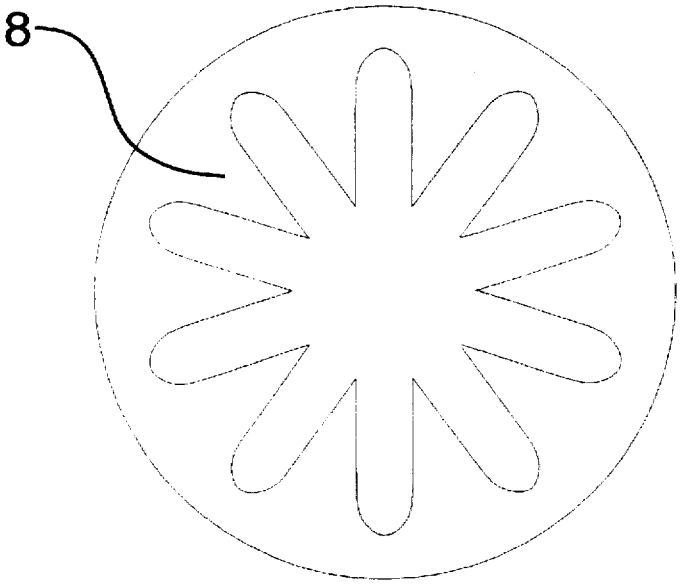
In FIG. 2 the cross sectional view of the CCB, item 8, is shown.
Figure 3:
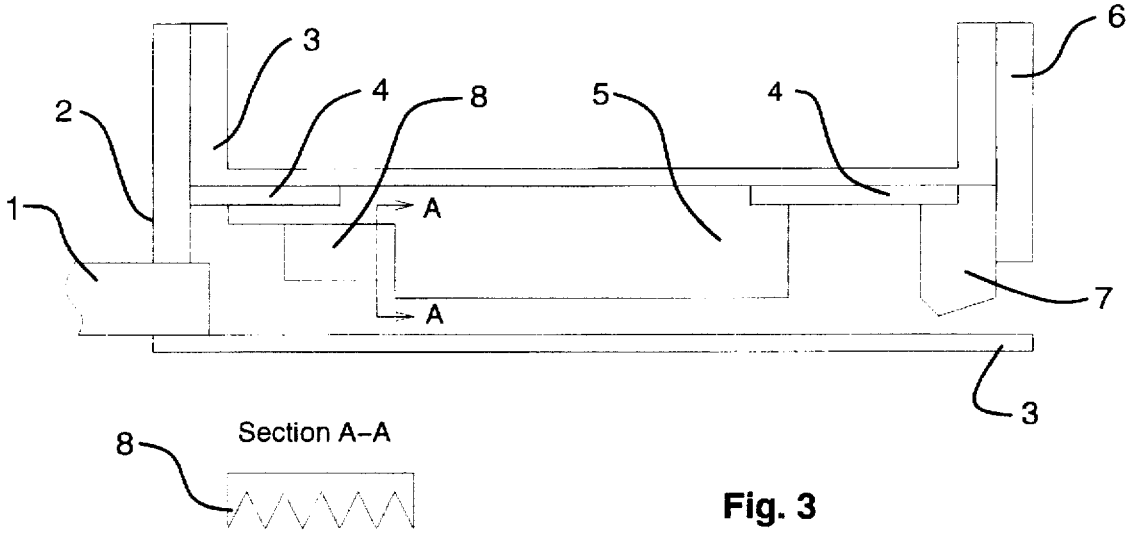
FIG. 3 is a side view of a 2-D planar hybrid motor combustion chamber that uses a planar/sawtooth CCB for ignition. The location of the CCB, item 8, in the hybrid motor is shown. Item 1 depicts the location of the forward injector through which the fluid is atomized and enters the combustion chamber. Items 2, 3 and 6 [not part of the invention] are the forward flange, the case and the aft flange respectively. These items serve as a pressure vessel for the combustion chamber. Item 4 [not part of the invention] is the internal thermal insulation which serves to protect the pressure vessel from the combustion gas temperatures. Item 7 [not part of the invention] is a nozzle through which the combustion gases exit, producing thrust. Item 5 is the solid grain for the hybrid rocket motor shown in a 2-D planar configuration. Also shown in FIG. 3 is an end view of the CCB, item 8. This view is the one seen looking from the injector (item 1) toward the nozzle (item 7).
Figure 4:
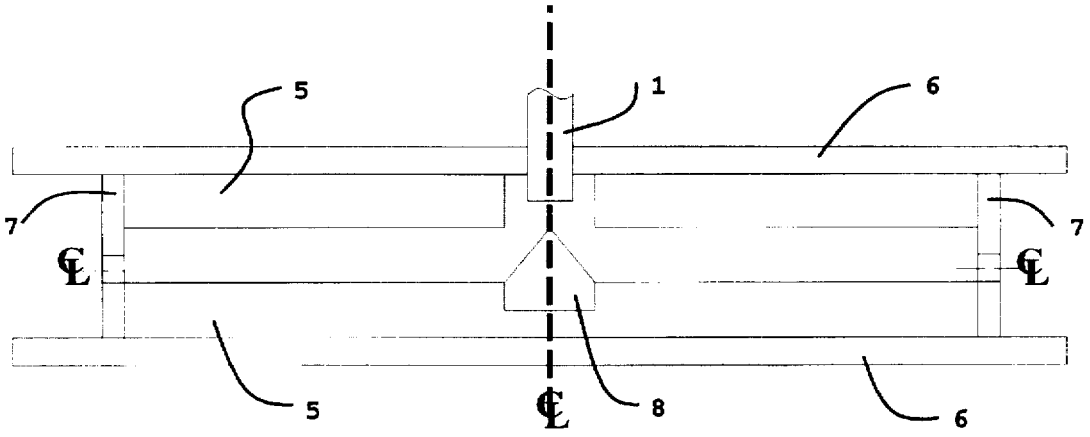
FIG. 4 is an axisymetric view of a radial flow hybrid motor combustion chamber that uses a solid cone (no fin surface) shaped CCB, item 8, for ignition. The location of the CCB (item 8) in the hybrid motor is shown to be centered on the forward face of the aft solid grain, item 5, plate. Item 1 depicts the location of the forward injector through which the fluid is atomized and enters the combustion chamber. Item 1 is shown protruding through the centerline of the forward solid grain, item 5. Item 6 [not part of the invention] is the forward flange and the aft flange. This item serves as a pressure vessel for the combustion chamber. Item 7 [not part of the invention] is a circular ring through which several simple orifice nozzles are cut, as indicated by the centerlines, through which the combustion gases exit. The solid grain (item 5) for the hybrid rocket motor shown as two circular flat plates.

Consequently, the CCB must be manufactured with the injected fluid in mind. Manufacture referring to the size (how big it must be), configuration (how much surface area must it have), chemistry (the type and amount of catalyst it must contain) and its location relative to the injected fluid. These items must be balanced by the type of injected fluid (chemistry), the fluid concentration (if diluted by a solvent), the neutralizing agents in the fluid (chemical stabilizers), the degree of liquid atomization (how big the droplets are, if any), the shape of the injected fluid pattern (solid, hollow cone or plane spray and the mass flow rate at which the fluid must be decomposed. As a result the CCB finds great flexibility in its uses for a hybrid system. Examples of embodiments of method and device are show in FIGS. 1, 3 and 4 for which the CCB is used in a hybrid motor.

DESCRIPTION OF THE PREFERRED EMBODIMENTS

The inventors conducted several tests to determine the method of operation of the CCB and best construction and composition. All such tests used weight percents of 80% to 90% of stabilized hydrogen peroxide. The stabilizer level for these tests was between 30 to 50 ppm. Ignition tests consisted of a complete combustion chamber configuration, as in FIG. 1, without the use of a nozzle. A drop test consists of, releasing under gravity, a shaped mass into an open cup that contains a small volume of said hydrogen peroxide.

All tests involving injected oxidizer were conducted on the 0.0508 m (2 in) outer diameter scale. In the tests where the fluid is injected (ignition tests and motor firings) the liquid hydrogen peroxide is injected into the center of the CCB in the form of an atomized solid cone spray. The mass mean diameter of the droplets are approximately 350 microns in this solid cone spray. Set forth below are examples of embodiments resulting from such tests:

Example (1): The problem of the prior art as described in the background of the invention is use of either unstabilized hydrogen peroxide or the use of complicated decomposition methods to achieve combustion. To eliminate this problem we conducted several drop tests with a shaped mass consisting of 20% to 70% of both potassium permanganate ($KMnO_4$) and manganese dioxide ($MnO_2$) in the binders of hydroxyl terminated polybutadiene and polyethylene. A number of these shaped masses were observed to undergo self sustained combustion after prolonged contact with the oxidizer. As a result we determined that an embodiment consisting of certain mixtures of a binder with a decomposition catalyst in the presence of stabilized hydrogen peroxide would obviate the problem.

Example (2): The problem of the prior art of Klein and Vessel et al., similar to that of example (1), is the use of large amounts of decomposition catalyst. To solve this problem approximately 10 ignition tests were conducted with CCBs made of 10% to 30% manganese dioxide in polyethylene. The idea being that the total decomposition catalyst amount in the solid grain could be significantly reduced by only placing catalyst in the oxidizer injection area. This would require an increase in the catalyst surface area thereby having sufficient catalyst for ignition while not being required for the duration of the motor firing. The reacting surface area was accomplished by drilling several holes in a cylinder of shaped mass of said chemistry. The CCB ratio of port cross sectional area to surface area required was accomplished by adjusting the number of drilled holes versus the diameter of those holes. Ignition achieved at port mass flux level near the Pugibet et al. range exhibited ignition delays of 1 to 7 sec. As a result we determined that an embodiment of specific shape, location and chemical composition would obviate the problem encountered by the use of the prior art of Vessel et al. and that of Klein.

Example (3): An alternative embodiment was discovered through the included use of a wagon wheel (thin strips of polyethylene in the shape of spokes of a wheel) coated with manganese dioxide to provide extra catalyst surface area without constricting the cross sectional port area. Approximately 10 tests in conjunction with the preferred CCB from the 10 previous ignition tests of example (2). Ignition tests where conducted in the Pugibet et al. mass flux range. Ignition delays from 0.5 to 2.0 seconds were observed. As a result we discovered that increased initial catalytic surface area did have the desired effect of decreased ignition delay time.

Example (4): An alternative embodiment to allow increased mass flux rates and to further decrease ignition delay times involved the use of an increased number of wagon wheels and increased catalyst mass percent in the CCB. Approximately 8 tests with a 6 fin CCB constructed of 50% to 65% manganese dioxide with the remainder being polyethylene were conducted. Several sections were attempted with a varying number of wagon wheels stacked between a varying number of CCBs. Mass flux levels approximately four times that of Pugibet et al. achieved ignition delays no less than 0.5 sec. As a result we discovered that by increasing initial catalytic surface is well as catalyst percent in the CCB increased oxidizer mass flux could be achieved.

Example (5): The ignition delay times achieved from the embodiments set forth in example (4) were still longer than desired aside from the mass flux levels being roughly half of that desired. To overcome these obstacles a more reactive hydrogen peroxide decomposition catalyst was selected. An ignition test with two 0.0254 m (1.0 in) long CCB sections placed on either side of a wagon wheel was performed. The forward CCB was coated with a mixture of sodium borohydride, polyethylene powder and rubber cement. The test was performed at port mass flux levels around eight times that of Pugibet et al. The test showed rapid ignition and then quenching after the sodium borohydride coating was consumed. This result showed that the prior art of Pugibet et al. wherein the fuel surface was coated with sodium borohydride would perhaps have quenched at the desired high mass flux levels using stabilized hydrogen peroxide and the given oxidizer injection spray.

Example (6): To sustain combustion at the mass flux levels set forth in example (5) the sodium borohydride catalyst was included in the chemistry of the CCB and was removed as a surface coating. A single test with one 6 fin CCB being 0.032 m (1.25 in) long and composed of 4.4% sodium borohydride, 51.5% polyester polymer and 44.1% polyethylene was performed. It was observed that the motor ignited rapidly then quenched. As a result we determined that an embodiment wherein a CCB containing a more reactive decomposition catalyst achieved ignition but would require increased mass percent if the combustion was to be sustained under the given fluid inlet conditions.

Example (7): In order to find a CCB chemical composition that would sustain combustion in a configuration identical to that of example (6) several mixtures (given as weight percents) were constructed. Drop tests were then performed:

| Mixture | 1 | 2 | 3 | 4 | 5 | 6 | 7 | 8 |
|---|---|---|---|---|---|---|---|---|
| sodium borohydride | 4.4 | 4.3 | 0.0 | 11.0 | 11.0 | 22.0 | 22.0 | 27 |
| polyethylene | 44.1 | 26 | 7.4 | 0.0 | 16.7 | 0.0 | 11 | 0.0 |
| manganese dioxide | 0.0 | 14.5 | 52 | 28 | 11 | 17 | 5.5 | 23 |
| polyester | 51.5 | 55 | 41 | 61 | 61 | 61 | 61 | 50 |

Mixture number 8 was preferred by observation.

Example (8): An alternative embodiment that accomplished the goals of rapid ignition as well as mass flux levels roughly eight times that of Pugibet et al. was discovered. This was accomplished by increasing the single CCB surface area by increasing the number of fins and with a chemical composition different from that of mixture number 8 given in example (7). A single 10 fin CCB 0.095 m (3.75 in) in length with composition: 19.5% sodium borohydride, 19.5% polyethylene, 19.5% manganese dioxide and 41.5% polyester polymer was used in an ignition test. Ignition was rapid and sustained to consumption of oxidizer around 6 seconds duration. As a result we determined that an embodiment wherein a shaped mass containing sufficient hydrogen peroxide decomposition catalyst as given obtained the desired result of minimal decomposition catalyst, rapid ignition and sustained combustion using stabilized high concentration hydrogen peroxide injected into the forward end of the combustion chamber.

Example (9): An alternative embodiment that reduces the concentration of sodium borohydride from that described in example (8) was tested with a CCB made of 10% less sodium borohydride and 10% more manganese dioxide. Ignition was rapid and combustion sustained to consumption of oxidizer. Post-fire showed evidence of incomplete hydrogen peroxide decomposition. As a result we determined that an embodiment wherein a shaped mass containing a 10% by mass trade of sodium borohydride for manganese dioxide accomplished the desired result of rapid ignition and sustained combustion. This embodiment could be made to completely decompose the hydrogen peroxide if one of the following or a combination of the following were done: increased hydrogen peroxide concentration, decreased stabilizer level, decreased injected droplet size, increased CCB surface area, decreased injected oxidizer mass flux level.

Example (10): A test was conducted wherein the fuel surface was coated with sodium borohydride in a glue to completely confirm the stipulation of example (5). Being that a surface coating would lead to ignition quenching at oxidizer mass flux levels eight times that of the Pugibet et al. level. Several ignition tests were done with a configuration identical to that of example (9) without the CCB. Ignition was immediately quenched in each of the tests performed under the given conditions. This result showed that a method of a catalytic surface coating would not achieve the desired result of rapid ignition and sustained combustion.

Example (11): Approximately 40 successful tests with a single CCB configuration employing a multi-fin geometry and composed by weight percents of: 15% sodium borohydride ($NaBH_4$), 25% manganese dioxide ($MnO_2$), the remainder comprised of 40% polyester and 20% polyethylene polymers. The CCB device used to test useful mass flux ranges had 10 fins was 0.064 m (2.5 in) in length and 0.032 m (1.25 in) in diameter. The surface of the fins were roughed using a round carbide-grit blade prior to being tested. The liquid hydrogen peroxide is injected into the center of the CCB in the form of an atomized solid cone spray. Mass fluxes up to 560 kg/s-m$^2$ (0.8 lbm/s-in$^2$) have been successfully tested with stabilized hydrogen peroxide of concentrations greater than 80% by weight. The ignition delay was observed to be less than 50 msec.

Example (12): Approximately 10 successful tests with a single CCB as described in example (11) without roughing the fin surfaces and composed in weight percents of: 20.4% sodium borohydride ($NaBH_4$), 39.8% manganese dioxide ($MnO_2$), the remained comprised of 39.8% polyethylene polymer. This serves to make the manufacture of the CCB simpler using less raw materials and elimination of a polyester curing catalyst. The ignition delay was observed to be less than 50 msec.

Example (13): Approximately 5 successful tests with a single CCB described by the following preferred embodiments: The CCB configuration is that described in example (12) and composed by weight percents of: 20.4% sodium borohydride ($NaBH_4$), 21.4% manganese dioxide ($MnO_2$) and 58.2% polyethylene polymer. This serves to reduced the amount of manganese dioxide required in construction of the CCB from the previous embodiment. The ignition delay was observed to be less than 50 msec.

What is claimed is:

1. A method of initiating a combustion reaction of an injected fluid with a solid grain which comprises the step of injecting the fluid onto a consumable catalytic bed comprised of a solid material that:
   (a) decomposes the injected fluid upon contact of the injected fluid with the solid material through a reaction of the injected fluid with the solid material;
   (b) releases energy and products from the injected fluid or the solid material sufficient to vaporize the solid material and initiate the combustion reaction of the injected fluid with the solid grain;
   (c) has an integral self supporting structure with a surface area substantially exposed to the injected fluid;
   (d) sustains the decomposition of the injected fluid until the combustion reaction continues without the aid of the consumable catalytic bed or until the injected fluid is no longer injected; and
   (e) is substantially consumed during the initiation of the combustion reaction or during the injecting of the fluid.

2. The method of claim 1 wherein the injected fluid is a hydrogen peroxide solution.

3. The method of claim 1 wherein the injected fluid is a hydrogen peroxide solution that is stabilized.

4. The method of claim 1 wherein
   (a) the injected fluid is comprised of a hydrogen peroxide solution
   (b) the solid grain is a fuel and
   (c) the solid material is comprised of a material which is catalytic with hydrogen peroxide.

5. The method of claim 1 wherein
   (a) the injected fluid is a stabilized hydrogen peroxide solution and
   (b) the solid material is comprised of a catalyst selected from the compounds of the metallic hydride family, the cuprocyanide family and the manganate oxide family.

6. The method of claim 1 wherein (a) the injected fluid is comprised of a hydrogen peroxide solution and (b) the solid material is comprised in weight percents of:
(i) 5% to 30% $NaBH_4$;
(ii) zero to 75% $MnO_2$ and
(iii) the remainder being a binder.

7. The method of claim 1 wherein the solid material is substantially in the shape of a cylinder with an axially located hole.

8. The method of claim 1 wherein the injected fluid is of sufficient mass flux level practical for propulsion.

9. The method of claim 1 wherein (a) the injected fluid is comprised of a hydrazine solution and (b) the solid material is comprised of a material which is catalytic with hydrazine.

10. The method of claim 1 wherein a) the injected fluid is comprised of a nitromethane solution and (b) the solid material is comprised of a material which is catalytic with nitromethane.

11. The method of claim 1 wherein (a) the injected fluid is comprised of a ethylene oxide solution and (b) the solid material is comprised of a material which is catalytic with ethylene oxide.

12. The method of claim 1 wherein (a) the injected fluid is comprised of a nitric acid solution and (b) the solid material is comprised of a material which is catalytic with nitric acid.

13. A hybrid motor system comprising:

(a) a injected fluid;

(b) a solid grain that is located downstream of the injected fluid and is capable of combustion with the injected fluid when the injected fluid is introduced to the solid grain; and (c) a consumable catalytic bed that is:
(i) located downstream from the injected fluid;
(ii) comprised of a solid material that has an integral self supporting structure and a surface area substantially exposed to the injected fluid;
(iii) decomposes the injected fluid upon contact of the injected fluid with the solid material through a reaction of the injected fluid with the solid material;
(iv) is substantially consumed during the initiation of the combustion reaction or during the injecting of the fluid; and
(v) sustains the decomposition of the injected fluid until the combustion reaction continues without the aid of the consumable catalytic bed or until the injected fluid is no longer injected.

14. The hybrid motor system in claim 13 wherein the injected fluid is a hydrogen peroxide solution.

15. The hybrid motor system in claim 13 wherein the injected fluid is hydrogen peroxide solution that is stabilized.

16. The hybrid motor system in claim 13 wherein the injected fluid is a hydrogen peroxide solution and the solid material is comprised of chemicals selected from the group consisting of the metallic hydride family, the manganate oxide family or the cuprocyanide family.

17. The hybrid motor system in claim 13 wherein the consumable catalytic bed is comprised of a solid material with an axially located hole.

18. The hybrid motor system in claim 13 wherein the solid material is comprised, in weight percents, of (a) 5% to 30% of $NaBH_4$, (b) zero to 75% $MnO_2$ and (c) the remainder being a binder.

19. The hybrid motor system in claim 13 wherein the injected fluid is in sufficient mass flux levels practical for propulsion.

20. The hybrid motor system in claim 13 wherein the injected fluid is atomized where the mass mean diameter diameter of the droplets is greater than 100 microns.

21. The hybrid motor system in claim 18 wherein the injected fluid is a hydrazine solution.

22. The hybrid motor system in claim 13 wherein the injected fluid is a nitromethane solution.

23. The hybrid motor system in claim 13 wherein the injected fluid is a ethylene oxide solution.

24. The hybrid motor system in claim 13 wherein the injected fluid is a nitric acid solution.

25. A consumable catalytic bed mounted downstream of an injected fluid and adjacent to a solid grain, the consumable catalytic bed being used to initiate a combustion reaction of said injected fluid with said solid grain said consumable catalytic bed being comprised of a solid material that is selected from the metallic hydride family and the manganate oxide family, the remainder being a binder.

26. The consumable catalytic bed in claim 25 wherein the injected fluid is a hydrogen peroxide solution and the solid material is comprised, in weight percents, of:
(i) 5% to 30% of $NaBH_4$,
(ii) zero to 75% $MnO_2$ and
(iii) the remainder being a binder.

* * * * *